US009179712B2

(12) United States Patent
Jaggernauth

(10) Patent No.: US 9,179,712 B2
(45) Date of Patent: Nov. 10, 2015

(54) ADJUSTABLE BABY GARMENT

(71) Applicant: Melissa Jaggernauth, Charlotte, NC (US)

(72) Inventor: Melissa Jaggernauth, Charlotte, NC (US)

( * ) Notice: Subject to any disclaimer, the term of this patent is extended or adjusted under 35 U.S.C. 154(b) by 1 day.

(21) Appl. No.: 14/012,435

(22) Filed: Aug. 28, 2013

(65) Prior Publication Data

US 2015/0059049 A1 Mar. 5, 2015

(51) Int. Cl.
*A41B 13/08* (2006.01)

(52) U.S. Cl.
CPC ..... *A41B 13/08* (2013.01); *A41B 2300/33* (2013.01)

(58) Field of Classification Search
CPC ..... A41B 1/00; A41B 1/08; A41B 13/005; A41B 13/00; A41B 13/08; A41B 13/06; A41B 2300/33; A41B 2300/00; A41B 2300/332; A41D 15/002; A41D 11/00; A41D 2300/00; A41D 2300/33; A41D 2300/332
USPC ..... 2/111, 75, 80, 269, 83, 106, 107, 78.3, 2/78.4
See application file for complete search history.

(56) References Cited

U.S. PATENT DOCUMENTS 461,434 A * 10/1891 Henry ..... 2/269
560,683 A * 5/1896 Bruckner ..... 2/227
823,534 A * 6/1906 Hutchinson ..... 2/269
1,157,265 A * 10/1915 Tutelman ..... 2/269
2,127,763 A * 8/1938 Bentz ..... 2/85
2,153,068 A * 4/1939 Arden ..... 2/269
2,280,467 A * 4/1942 Blanc ..... 2/162
2,675,554 A * 4/1954 Gertz ..... 2/80
2,687,530 A * 8/1954 Farnum ..... 2/217
2,918,677 A * 12/1959 Pindyck ..... 2/111
5,299,323 A * 4/1994 Schaefer et al. ..... 2/93
5,367,709 A * 11/1994 Teasley ..... 2/69
6,243,871 B1 * 6/2001 Fidler ..... 2/80
6,317,894 B1 * 11/2001 Blechman ..... 2/269
7,168,103 B2 * 1/2007 Aldridge et al. ..... 2/458
2010/0299802 A1 * 12/2010 Bailey et al. ..... 2/70

* cited by examiner

*Primary Examiner* — Amy Vanatta

(74) *Attorney, Agent, or Firm* — Tillman Wright, PLLC; Jeremy C. Doerre; Chad D. Tillman

(57) ABSTRACT

A one-piece garment (e.g. infant/toddler Onesie or body suit) includes independent elastic bands threaded alongside the body of the garment, from the underarms down to the hip, that when pulled allow for custom fitting of the garment. Once pulled to the desired length, the bands are securable with a snap fastener post, located at the end of the strap, to snap fastener studs, located at varying points on the inside of the garment. The contraction of the elastic bands preferably creates a drawstring effect and provides a gathering force upon the garment, which is held securely in place with the snap fastener so that the one-piece garment thereby shortens in length around a wearer's torso creating a custom fit. The one-piece garment can be expanded as needed by releasing the snap fastener post and positioning it on a lower positioned snap fastener stud.

17 Claims, 9 Drawing Sheets

10

10

10

10

110

ADJUSTABLE BABY GARMENT

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

BACKGROUND OF THE INVENTION

The present invention generally relates to garments for infants and small children.

One piece garments are commonly worn by infants and small children, but because they commonly grow very fast, it is not unusual for children to quickly outgrow a particular garment.

Needs exist for improvement in garments for infants and small children. These, and other needs, are addressed by one or more aspects of the present invention.

SUMMARY OF THE INVENTION

The present invention includes many aspects and features. Moreover, while many aspects and features relate to, and are described in, the context of one piece baby garments, the present invention is not limited to use only in this context, as will become apparent from the following summaries and detailed descriptions of aspects, features, and one or more embodiments of the present invention.

Accordingly, one aspect of the present invention relates to an adjustable garment for a small child. The garment includes a body portion configured to generally fit about a body of a child, and a first adjustable fit mechanism disposed at a first side of the body portion. The first adjustable fit mechanism includes a first set of one or more fastening members affixed to an interior of the body portion at the first side of the body portion, a first strap channel defined through the body portion at the first side, and an elastic first strap at least partially received within the first strap channel. A first end of the first strap is secured to an interior of the body portion within the first strap channel at the first side of the body portion proximate a chest portion of the body portion. The first strap includes a second set of one or more fastening members affixed to the first strap proximate a second end of the first strap. The first strap is threaded through the first strap channel such that a first extent of the first strap is disposed within the first strap channel and a second extent of the first strap is disposed exterior to the first strap channel. A secured portion of the first strap that is disposed exterior to the first strap channel is removably secured to the body portion via coupling of one or more fastening members of the second set of one or more fastening members with one or more fastening members of the first set of one or more fastening members. The garment further includes a second adjustable fit mechanism disposed at a second side of the body portion. The second adjustable fit mechanism includes a third set of one or more fastening members affixed to an interior of the body portion at the second side of the body portion, a second strap channel defined through the body portion at the second side, and an elastic second strap at least partially received within the second strap channel. A first end of the second strap is secured to an interior of the body portion within the second strap channel at the second side of the body portion proximate a chest portion of the body portion. The second strap includes a fourth set of one or more fastening members affixed to the second strap proximate a second end of the second strap. The second strap is threaded through the second strap channel such that a first extent of the second strap is disposed within the second strap channel and a second extent of the second strap is disposed exterior to the second strap channel. A secured portion of the second strap that is disposed exterior to the second strap channel is removably secured to the body portion via coupling of one or more fastening members of the fourth set of one or more fastening members with one or more fastening members of the third set of one or more fastening members. The adjustable garment is configured such that a length of the adjustable garment can be increased by unsecuring the secured portion of the first strap from the body portion by decoupling the one or more fastening members of the second set of one or more fastening members from the one or more fastening members of the first set of one or more fastening members, decreasing the second extent of the first strap disposed exterior to the first strap channel, re-securing the first strap to the body portion at the first side by coupling one or more fastening members of the second set of one or more fastening members to one or more fastening members of the first set of one or more fastening members, unsecuring the secured portion of the second strap from the body portion by decoupling the one or more fastening members of the fourth set of one or more fastening members from the one or more fastening members of the third set of one or more fastening members, decreasing the second extent of the second strap disposed exterior to the second strap channel, and re-securing the second strap to the body portion at the second side by coupling one or more fastening members of the fourth set of one or more fastening members to one or more fastening members of the third set of one or more fastening members. The adjustable garment is configured such that a length of the adjustable garment can be decreased by unsecuring the secured portion of the first strap from the body portion by decoupling the one or more fastening members of the second set of one or more fastening members from the one or more fastening members of the first set of one or more fastening members, increasing the second extent of the first strap disposed exterior to the first strap channel, re-securing the first strap to the body portion at the first side by coupling one or more fastening members of the second set of one or more fastening members to one or more fastening members of the first set of one or more fastening members, unsecuring the secured portion of the second strap from the body portion by decoupling the one or more fastening members of the fourth set of one or more fastening members from the one or more fastening members of the third set of one or more fastening members, increasing the second extent of the second strap disposed exterior to the second strap channel, and re-securing the second strap to the body portion at the second side by coupling one or more fastening members of the fourth set of one or more fastening members to one or more fastening members of the third set of one or more fastening members.

In one or more implementations in accordance with this aspect, fastening members of the first and third sets of one or more fastening members comprise male fastening members, and fastening members of the second and fourth sets of one or more fastening members comprise female fastening members.

In one or more implementations in accordance with this aspect, fastening members of the first and third sets of one or more fastening members comprise female fastening members, and fastening members of the second and fourth sets of one or more fastening members comprise male fastening members.

In one or more implementations in accordance with this aspect, one or more fastening members of the first and third sets of one or more fastening members comprise one or more hook fastening members, and one or more fastening members of the second and fourth sets of one or more fastening members comprise one or more loop fastening members.

In one or more implementations in accordance with this aspect, one or more fastening members of the first and third sets of one or more fastening members comprise one or more loop fastening members, and one or more fastening members of the second and fourth sets of one or more fastening members comprise one or more hook fastening members.

In one or more implementations in accordance with this aspect, one or more fastening members of one of the first, second, third, and fourth sets of one or more fastening members comprises a button fastening member.

In one or more implementations in accordance with this aspect, one or more fastening members of one of the first, second, third, and fourth sets of one or more fastening members comprises a snap fastening member.

In one or more implementations in accordance with this aspect, one or more fastening members of one of the first, second, third, and fourth sets of one or more fastening members comprises a hook and loop fastening member.

In one or more implementations in accordance with this aspect, the second and fourth sets of one or more fastening members each includes only a single fastening member.

In one or more implementations in accordance with this aspect, the first and third sets of one or more fastening members each includes only a single fastening member.

In one or more implementations in accordance with this aspect, the first, second, third, and fourth sets of one or more fastening members each includes only a single fastening member.

In one or more implementations in accordance with this aspect, the adjustable garment comprises sleeves.

In one or more implementations in accordance with this aspect, the adjustable garment is sleeveless.

In one or more implementations in accordance with this aspect, the adjustable garment comprises leggings.

In one or more implementations in accordance with this aspect, the adjustable garment does not include leggings.

In one or more implementations in accordance with this aspect, the adjustable garment includes a hood.

Another aspect relates to a method comprising decreasing a length of an adjustable garment. The garment includes a body portion configured to generally fit about a body of a child, and a first adjustable fit mechanism disposed at a first side of the body portion. The first adjustable fit mechanism includes a first set of one or more fastening members affixed to an interior of the body portion at the first side of the body portion, a first strap channel defined through the body portion at the first side, and an elastic first strap at least partially received within the first strap channel. A first end of the first strap is secured to an interior of the body portion within the first strap channel at the first side of the body portion proximate a chest portion of the body portion. The first strap includes a second set of one or more fastening members affixed to the first strap proximate a second end of the first strap. The first strap is threaded through the first strap channel such that a first extent of the first strap is disposed within the first strap channel and a second extent of the first strap is disposed exterior to the first strap channel. A secured portion of the first strap that is disposed exterior to the first strap channel is removably secured to the body portion via coupling of one or more fastening members of the second set of one or more fastening members with one or more fastening members of the first set of one or more fastening members. The garment further includes a second adjustable fit mechanism disposed at a second side of the body portion. The second adjustable fit mechanism includes a third set of one or more fastening members affixed to an interior of the body portion at the second side of the body portion, a second strap channel defined through the body portion at the second side, and an elastic second strap at least partially received within the second strap channel. A first end of the second strap is secured to an interior of the body portion within the second strap channel at the second side of the body portion proximate a chest portion of the body portion. The second strap includes a fourth set of one or more fastening members affixed to the second strap proximate a second end of the second strap. The second strap is threaded through the second strap channel such that a first extent of the second strap is disposed within the second strap channel and a second extent of the second strap is disposed exterior to the second strap channel. A secured portion of the second strap that is disposed exterior to the second strap channel is removably secured to the body portion via coupling of one or more fastening members of the fourth set of one or more fastening members with one or more fastening members of the third set of one or more fastening members. In accordance with the method, decreasing a length of the adjustable garment comprises decreasing a length of the adjustable garment by unsecuring a secured portion of the first strap from the body portion by decoupling the one or more fastening members of the second set of one or more fastening members from the one or more fastening members of the first set of one or more fastening members, increasing the second extent of the first strap disposed exterior to the first strap channel, re-securing the first strap to the body portion at the first side by coupling one or more fastening members of the second set of one or more fastening members to one or more fastening members of the first set of one or more fastening members, unsecuring the secured portion of the second strap from the body portion by decoupling the one or more fastening members of the fourth set of one or more fastening members from the one or more fastening members of the third set of one or more fastening members, increasing the second extent of the second strap disposed exterior to the second strap channel, and re-securing the second strap to the body portion at the second side by coupling one or more fastening members of the fourth set of one or more fastening members to one or more fastening members of the third set of one or more fastening members.

Another aspect relates to a method comprising increasing a length of an adjustable garment. The garment includes a body portion configured to generally fit about a body of a child, and a first adjustable fit mechanism disposed at a first side of the body portion. The first adjustable fit mechanism includes a first set of one or more fastening members affixed to an interior of the body portion at the first side of the body portion, a first strap channel defined through the body portion at the first side, and an elastic first strap at least partially received within the first strap channel. A first end of the first strap is secured to an interior of the body portion within the first strap channel at the first side of the body portion proximate a chest portion of the body portion. The first strap includes a second set of one or more fastening members affixed to the first strap proximate a second end of the first strap. The first strap is threaded through the first strap channel such that a first extent of the first strap is disposed within the first strap channel and a second extent of the first strap is disposed exterior to the first strap channel. A secured portion of the first strap that is disposed exterior to the first strap channel is removably secured to the body portion via coupling of one or more fastening members of the second set of one or more fastening members with one or more fastening members of the first set of one or more fastening members. The garment further includes a second adjustable fit mechanism disposed at a second side of the body portion. The second adjustable fit mechanism includes a third set of one or more fastening members affixed to an interior of the body portion at the second side of the body portion, a second strap channel defined through the body portion at the second side, and an elastic second strap at least partially received within the second strap channel. A first end of the second strap is secured to an interior of the body portion within the second strap channel at the second side of the body portion proximate a chest portion of the body portion. The second strap includes a fourth set of one or more fastening members affixed to the second strap proximate a second end of the second strap. The second strap is threaded through the second strap channel such that a first extent of the second strap is disposed within the second strap channel and a second extent of the second strap is disposed exterior to the second strap channel. A secured portion of the second strap that is disposed exterior to the second strap channel is removably secured to the body portion via coupling of one or more fastening members of the fourth set of one or more fastening members with one or more fastening members of the third set of one or more fastening members. In accordance with the method, increasing a length of the adjustable garment comprises increasing a length of the adjustable garment by unsecuring a secured portion of the first strap from the body portion by decoupling the one or more fastening members of the second set of one or more fastening members from the one or more fastening members of the first set of one or more fastening members, decreasing the second extent of the first strap disposed exterior to the first strap channel, re-securing the first strap to the body portion at the first side by coupling one or more fastening members of the second set of one or more fastening members to one or more fastening members of the first set of one or more fastening members, unsecuring the secured portion of the second strap from the body portion by decoupling the one or more fastening members of the fourth set of one or more fastening members from the one or more fastening members of the third set of one or more fastening members, decreasing the second extent of the second strap disposed exterior to the second strap channel, and re-securing the second strap to the body portion at the second side by coupling one or more fastening members of the fourth set of one or more fastening members to one or more fastening members of the third set of one or more fastening members.

Another aspect relates to an adjustable garment for a small child. The garment includes a body portion configured to generally fit about a body of a child, and a first adjustable fit mechanism disposed at a first side of the body portion. The first adjustable fit mechanism includes a first set of one or more fastening members secured to an exterior of the body portion at the first side of the body portion, a first strap opening defined through the body portion at the first side proximate a waist portion of the body portion, and a first strap. A first end of the first strap is secured to an interior of the body portion at the first side of the body portion proximate a chest portion of the body portion. The first strap includes a second set of one or more fastening members affixed to the first strap proximate a second end of the first strap. The first strap is threaded through the first strap opening such that a first extent of the first strap is disposed within an interior of the body portion and a second extent of the first strap is disposed exterior to the body portion. A secured portion of the first strap that is disposed exterior to the body portion is removably secured to the body portion via coupling of one or more fastening members of the second set of one or more fastening members with one or more fastening members of the first set of one or more fastening members. The garment further includes a second adjustable fit mechanism disposed at a second side of the body portion. The second adjustable fit mechanism includes a third set of one or more fastening members secured to an exterior of the body portion at the second side of the body portion, a second strap opening defined through the body portion at the second side proximate the waist portion of the body portion, and a second strap. A first end of the second strap is secured to an interior of the body portion at the second side of the body portion proximate the chest portion of the body portion. The second strap includes a fourth set of one or more fastening members affixed to the second strap proximate a second end of the second strap. The second strap is threaded through the second strap opening such that a first extent of the second strap is disposed within an interior of the body portion and a second extent of the second strap is disposed exterior to the body portion. A secured portion of the second strap that is disposed exterior to the body portion is removably secured to the body portion via coupling of one or more fastening members of the fourth set of one or more fastening members with one or more fastening members of the third set of one or more fastening members. The adjustable garment is configured such that a length of the adjustable garment can be increased by unsecuring the secured portion of the first strap from the body portion by decoupling the one or more fastening members of the second set of one or more fastening members from the one or more fastening members of the first set of one or more fastening members, decreasing the second extent of the first strap disposed exterior to the body portion by pushing or pulling some of the first strap back through the first strap opening, re-securing the first strap to the body portion at the first side by coupling one or more fastening members of the second set of one or more fastening members to one or more fastening members of the first set of one or more fastening members, unsecuring the secured portion of the second strap from the body portion by decoupling the one or more fastening members of the fourth set of one or more fastening members from the one or more fastening members of the third set of one or more fastening members, decreasing the second extent of the second strap disposed exterior to the body portion by pushing or pulling some of the second strap back through the second strap opening, and re-securing the second strap to the body portion at the second side by coupling one or more fastening members of the fourth set of one or more fastening members to one or more fastening members of the third set of one or more fastening members. The adjustable garment is configured such that a length of the adjustable garment can be decreased by unsecuring the secured portion of the first strap from the body portion by decoupling the one or more fastening members of the second set of one or more fastening members from the one or more fastening members of the first set of one or more fastening members, increasing the second extent of the first strap disposed exterior to the body portion by pushing or pulling some of the first strap through the first strap opening, re-securing the first strap to the body portion at the first side by coupling one or more fastening members of the second set of one or more fastening members to one or more fastening members of the first set of one or more fastening members, unsecuring the secured portion of the second strap from the body portion by decoupling the one or more fastening members of the fourth set of one or more fastening members from the one or more fastening members of the third set of one or more fastening members, increasing the second extent of the second strap disposed exterior to the body portion by pushing or pulling some of the second strap through the second strap opening, and re-securing the second strap to the body portion at the second side by coupling one or more fastening members of the fourth set of one or more fastening members to one or more fastening members of the third set of one or more fastening members.

Another aspect relates to a method comprising threading a first strap of the adjustable garment through a first strap opening of the adjustable garment such that a first extent of the first strap is disposed within an interior of the body portion of the adjustable garment and a second extent of the first strap is disposed exterior to the body portion of the adjustable garment, wherein the first strap opening is defined through a body portion of the adjustable garment at a first side proximate a waist portion of the body portion of the adjustable garment, and a first end of the first strap is secured to an interior of the body portion at the first side of the body portion proximate a chest portion of the body portion of the adjustable garment; threading a second strap of the adjustable garment through a second strap opening of the adjustable garment such that a first extent of the second strap is disposed within an interior of the body portion of the adjustable garment and a second extent of the second strap is disposed exterior to the body portion of the adjustable garment, wherein the second strap opening is defined through a body portion of the adjustable garment at a second side proximate the waist portion of the body portion of the adjustable garment, and a first end of the second strap is secured to an interior of the body portion at the second side of the body portion proximate the chest portion of the body portion of the adjustable garment; disposing the adjustable garment about a child such that a body of the child is generally received within the body portion of the adjustable garment; decreasing a length of the adjustable garment by increasing the second extent of the first strap disposed exterior to the body portion by pulling more of the first strap through the first strap opening, securing the first strap to the body portion at the first side by coupling one or more fastening members of the first strap to one or more fastening members disposed on the body portion at the first side, increasing the second extent of the second strap disposed exterior to the body portion by pulling more of the second strap through the second strap opening, and securing the second strap to the body portion at the second side by coupling one or more fastening members of the second strap to one or more fastening members disposed on the body portion at the second side.

Another aspect relates to a method comprising decreasing a length of an adjustable garment, the adjustable garment comprising a body portion configured to generally fit about a body of a child, a first adjustable fit mechanism disposed at a first side of the body portion, the first adjustable fit mechanism comprising a first set of one or more fastening members secured to an exterior of the body portion at the first side of the body portion, a first strap opening defined through the body portion at the first side proximate a waist portion of the body portion, and a first strap, wherein a first end of the first strap is secured to an interior of the body portion at the first side of the body portion proximate a chest portion of the body portion, the first strap includes a second set of one or more fastening members affixed to the first strap proximate a second end of the first strap, the first strap is threaded through the first strap opening such that a first extent of the first strap is disposed within an interior of the body portion and a second extent of the first strap is disposed exterior to the body portion, and a secured portion of the first strap that is disposed exterior to the body portion is removably secured to the body portion via coupling of one or more fastening members of the second set of one or more fastening members with one or more fastening members of the first set of one or more fastening members, a second adjustable fit mechanism disposed at a second side of the body portion, the second adjustable fit mechanism comprising a third set of one or more fastening members secured to an exterior of the body portion at the second side of the body portion, a second strap opening defined through the body portion at the second side proximate the waist portion of the body portion, and a second strap, wherein a first end of the second strap is secured to an interior of the body portion at the second side of the body portion proximate the chest portion of the body portion, the second strap includes a fourth set of one or more fastening members affixed to the second strap proximate a second end of the second strap, the second strap is threaded through the second strap opening such that a first extent of the second strap is disposed within an interior of the body portion and a second extent of the second strap is disposed exterior to the body portion, and a secured portion of the second strap that is disposed exterior to the body portion is removably secured to the body portion via coupling of one or more fastening members of the fourth set of one or more fastening members with one or more fastening members of the third set of one or more fastening members; wherein decreasing a length of the adjustable garment comprises decreasing a length of the adjustable garment by unsecuring a secured portion of the first strap from the body portion by decoupling the one or more fastening members of the second set of one or more fastening members from the one or more fastening members of the first set of one or more fastening members, increasing the second extent of the first strap disposed exterior to the body portion by pulling some of the first strap through the first strap opening, re-securing the first strap to the body portion at the first side by coupling one or more fastening members of the second set of one or more fastening members to one or more fastening members of the first set of one or more fastening members, unsecuring the secured portion of the second strap from the body portion by decoupling the one or more fastening members of the fourth set of one or more fastening members from the one or more fastening members of the third set of one or more fastening members, increasing the second extent of the second strap disposed exterior to the body portion by pulling some of the second strap through the second strap opening, and re-securing the second strap to the body portion at the second side by coupling one or more fastening members of the fourth set of one or more fastening members to one or more fastening members of the third set of one or more fastening members.

In one or more methodologies in accordance with this aspect, decreasing a length of an adjustable garment comprises decreasing a length of an adjustable garment being worn by a child.

In one or more methodologies in accordance with this aspect, decreasing a length of an adjustable garment comprises decreasing a length of an adjustable garment that is not being worn by a child.

In addition to the aforementioned aspects and features of the present invention, it should be noted that the present invention further encompasses the various possible combinations and subcombinations of such aspects and features. Thus, for example, any aspect may be combined with an aforementioned feature in accordance with the present invention without requiring any other aspect or feature.

BRIEF DESCRIPTION OF THE DRAWINGS

One or more preferred embodiments of the present invention now will be described in detail with reference to the accompanying drawings, wherein the same elements are referred to with the same reference numerals, and wherein.

FIGS. 3-6 illustrate a result of the exemplary methodology illustrated in FIGS. 3-5;

DETAILED DESCRIPTION

Figure 1A:
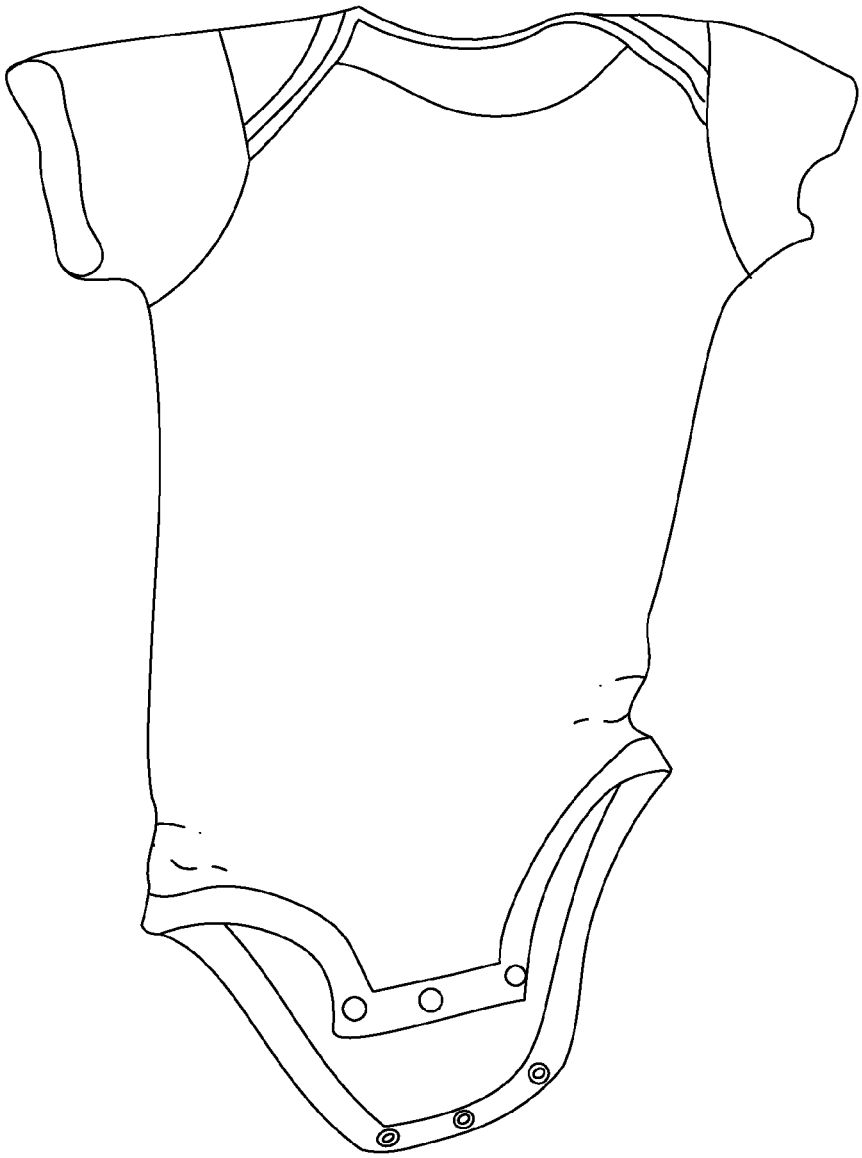
FIG. 1A is a front perspective view of a garment in accordance with one or more preferred implementations.

As a preliminary matter, it will readily be understood by one having ordinary skill in the relevant art ("Ordinary Artisan") that the present invention has broad utility and application. As should be understood, any embodiment may incorporate only one or a plurality of the above-disclosed aspects of the invention and may further incorporate only one or a plurality of the above-disclosed features. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. As should be understood, any embodiment may incorporate only one or a plurality of the above-disclosed aspects of the invention and may further incorporate only one or a plurality of the above-disclosed features. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Regarding applicability of 35 U.S.C. §112, ¶6, no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, one or more preferred embodiments of the present invention are next described. The following description of one or more preferred embodiments is merely exemplary in nature and is in no way intended to limit the invention, its implementations, or uses.

FIG. 1A is a front perspective view of an adjustable garment 10 in accordance with one or more preferred implementations. The garment 10 is configured to be adjustable in length to fit an infant or child as they grow. This is accomplished via the use of one or more adjustable fit mechanisms 12.

Figure 1B:
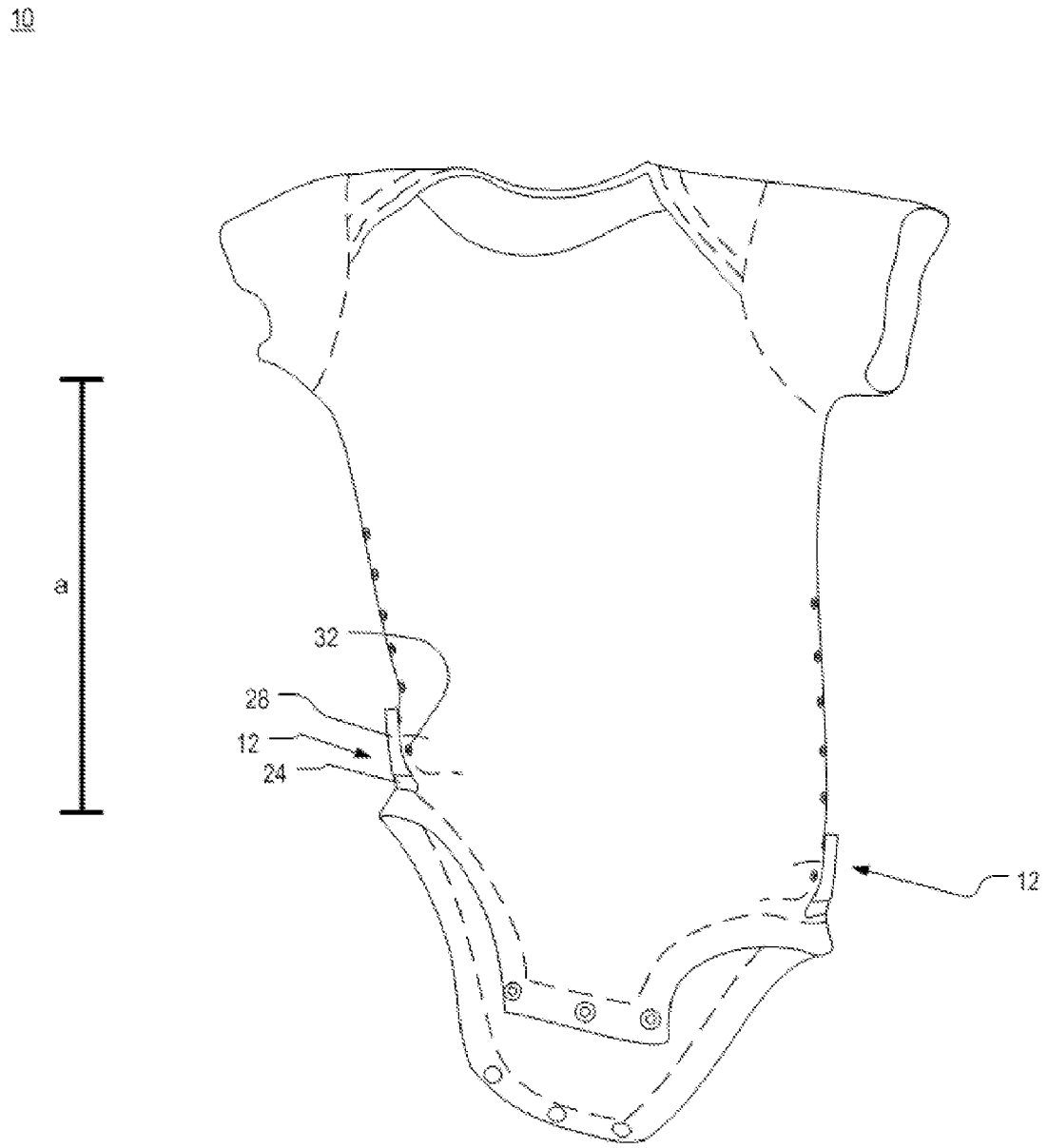
FIG. 1B illustrates the adjustable garment of FIG. 1A turned inside out so as to better illustrate its adjustable fit mechanisms.

FIG. 1B illustrates the adjustable garment turned inside out so as to better illustrate these adjustable fit mechanisms 12. Specifically, with respect to the garment 10, the garment 10 includes an adjustable fit mechanism 12 disposed proximate each of two opposite sides of the garment 10, as illustrated in FIG. 1B.

Each adjustable fit mechanism 12 of the garment 10 comprises an adjustable strap or band 28 (which is preferably elastic), a strap channel configured for threading of at least a portion of the adjustable strap or band 28 therethrough, and one or more fastening members 32 configured for securement of the adjustable strap or band 28 once it has been threaded through the strap opening 24.

Preferably, a first end of each strap 28 is secured to an interior of the garment 10 within a respective strap channel (although in at least some preferred implementations it may be outside of a strap channel) at a portion of the garment configured to be positioned proximate a wearer's chest or armpit, and the second, free end is disposed exterior to the corresponding strap channel on that side of the garment 10 and configured to be secured to a body of the garment via one or more respective fastening members 32 of that adjustable fit mechanism 12.

Figure 2:
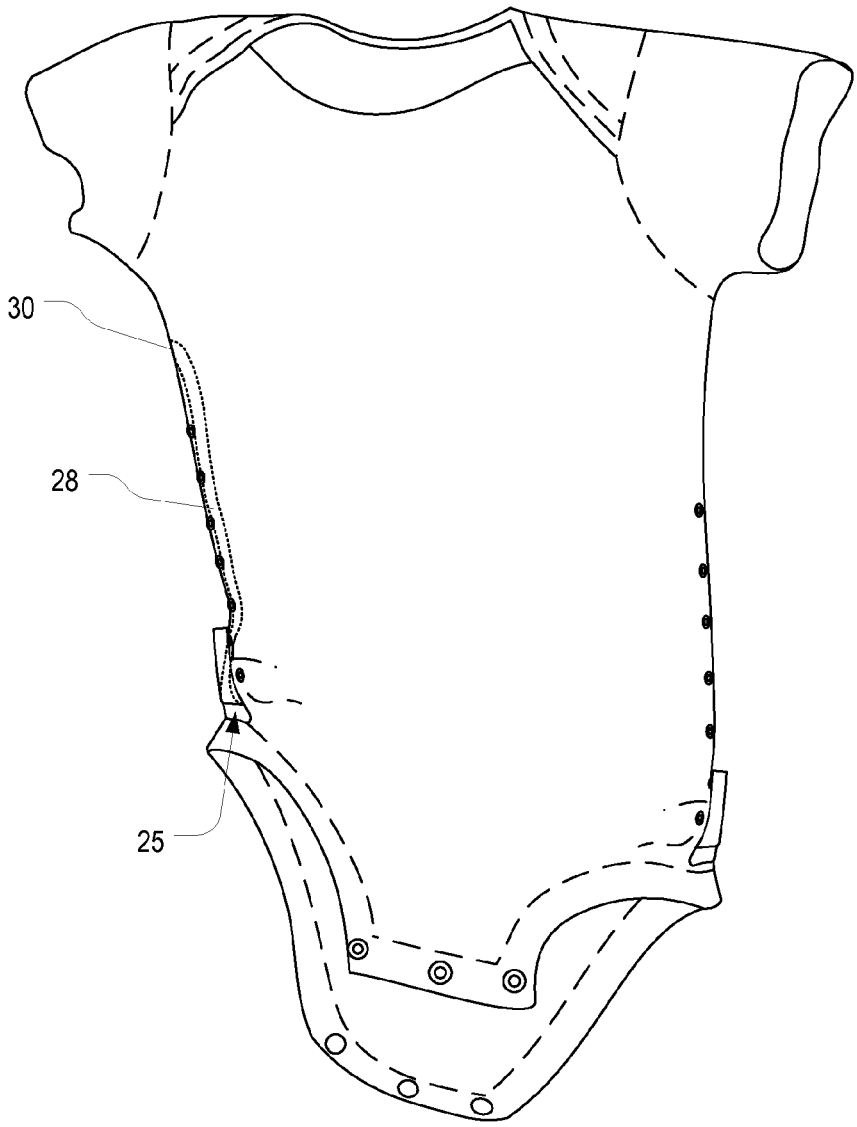
FIG. 2 illustrates an exemplary strap which is secured to an interior of the garment of FIG. 1A.

FIG. 2 illustrates an exemplary such strap 28 which is secured to an interior of the garment 10 at point 30, for example by being sewn to the interior of the garment 10, although in one or more preferred implementations a first side of a strap may be removably secured to an interior of a garment, e.g. utilizing one or more fastening members, such as snaps, buttons, or hook and loop fastening members. Although the portion of the strap 28 disposed inside of the strap channel 25 of the garment 10 obviously would normally not be visible from the exterior, the portion of the strap 28 disposed within the strap channel 25 that would normally not be visible is shown in broken lines in FIG. 2 for illustrative purposes.

Figure 3:
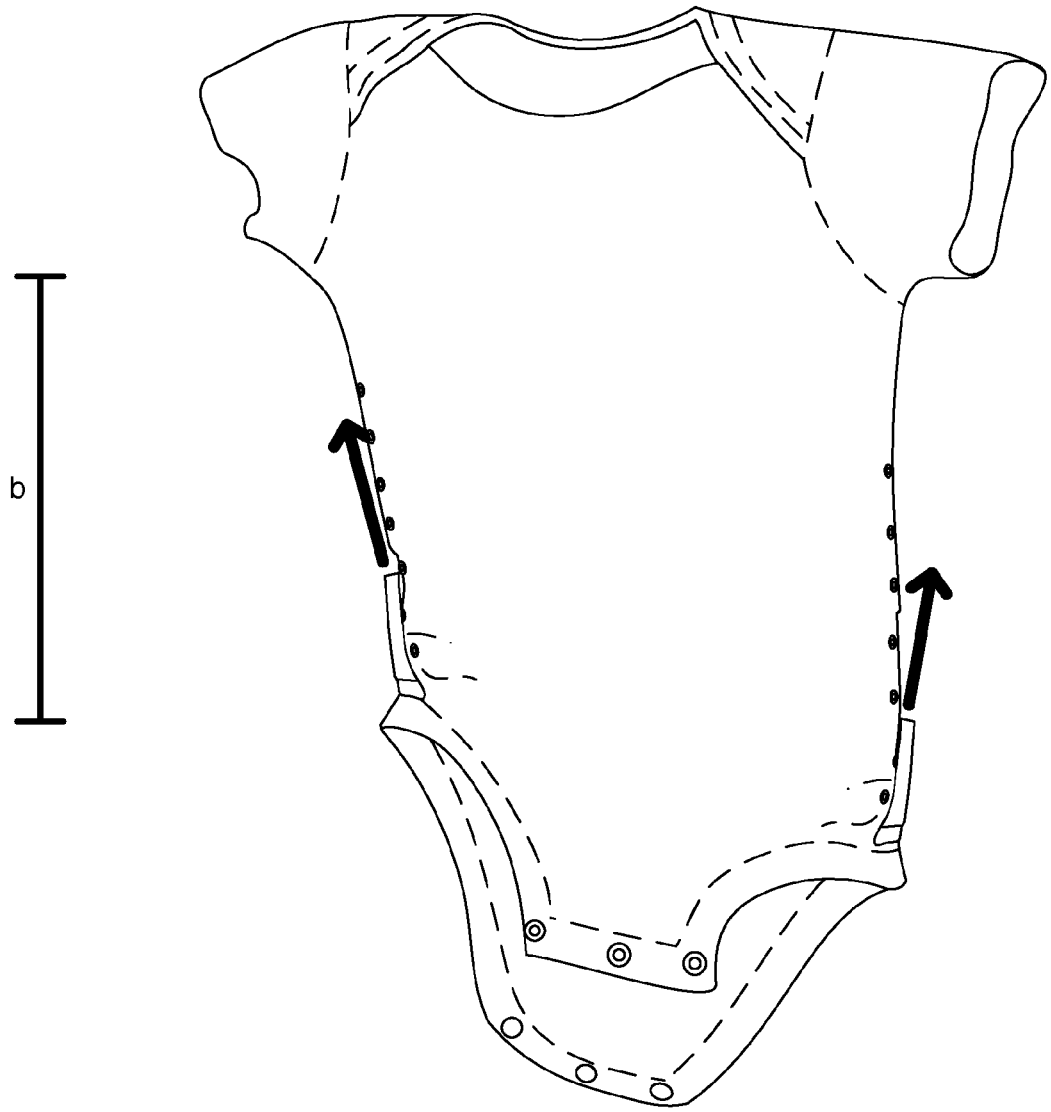
FIGS. 3-5 illustrate an exemplary methodology where a user pulls upwardly and outwardly on straps to increase the extent of the straps disposed exterior to strap channels and thereby decrease the length of the garment.
Figure 4:
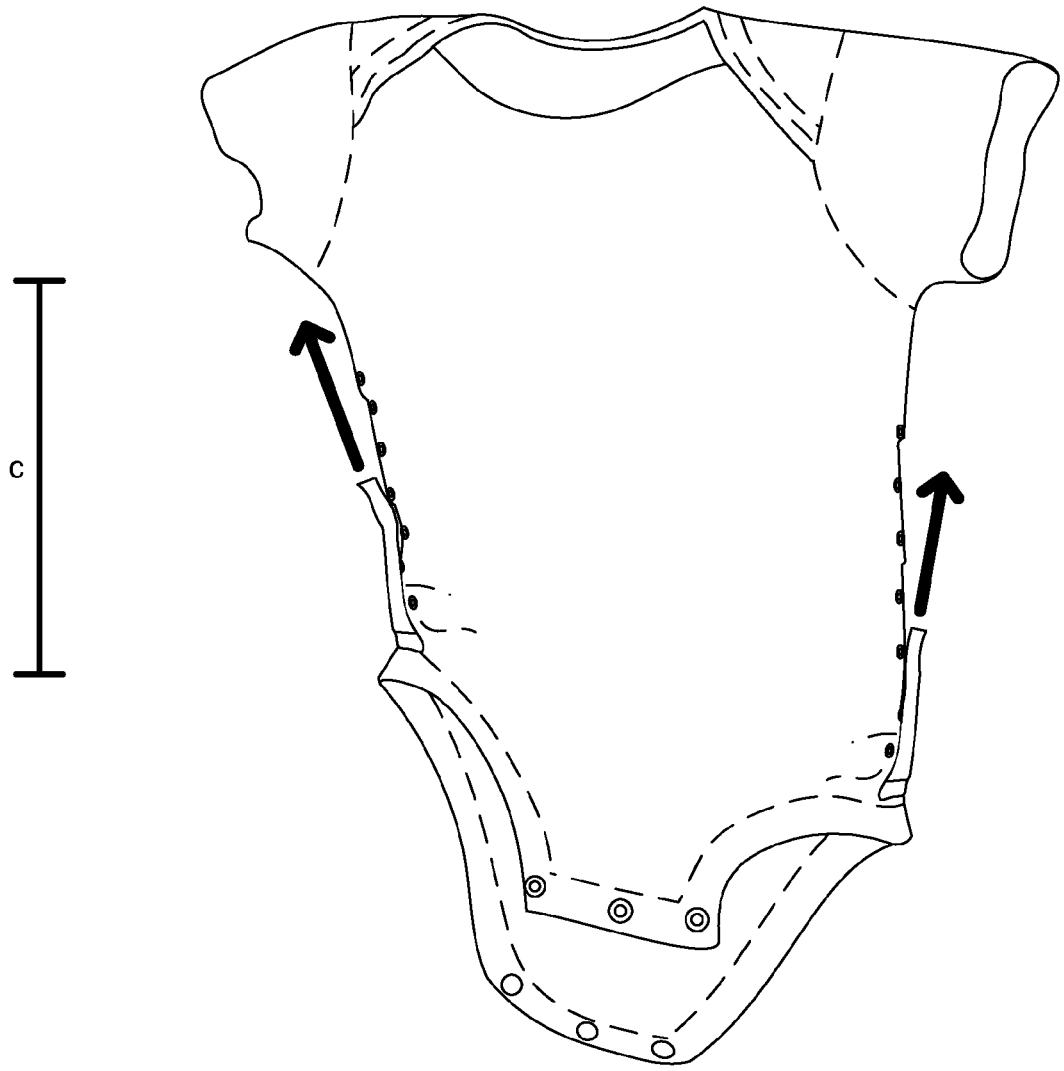
Figure 5:
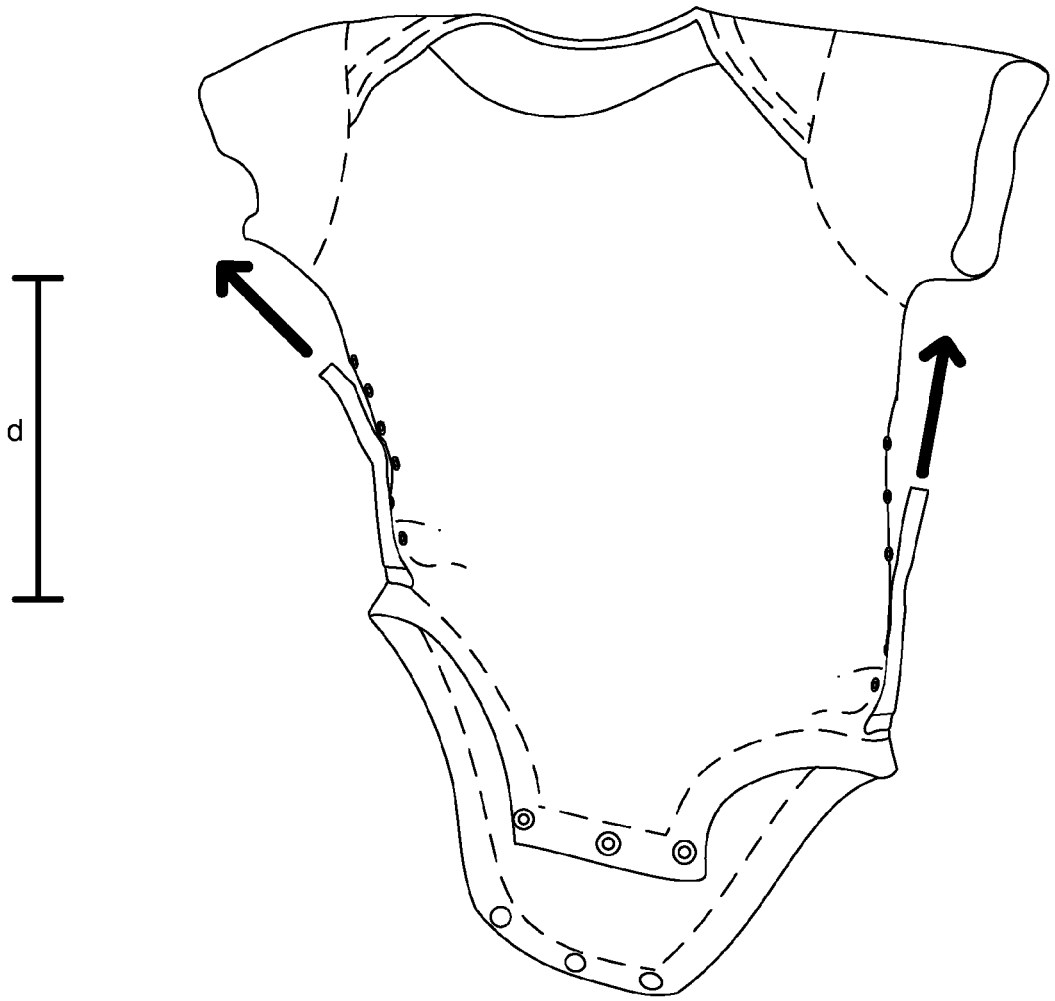
Figure 6:
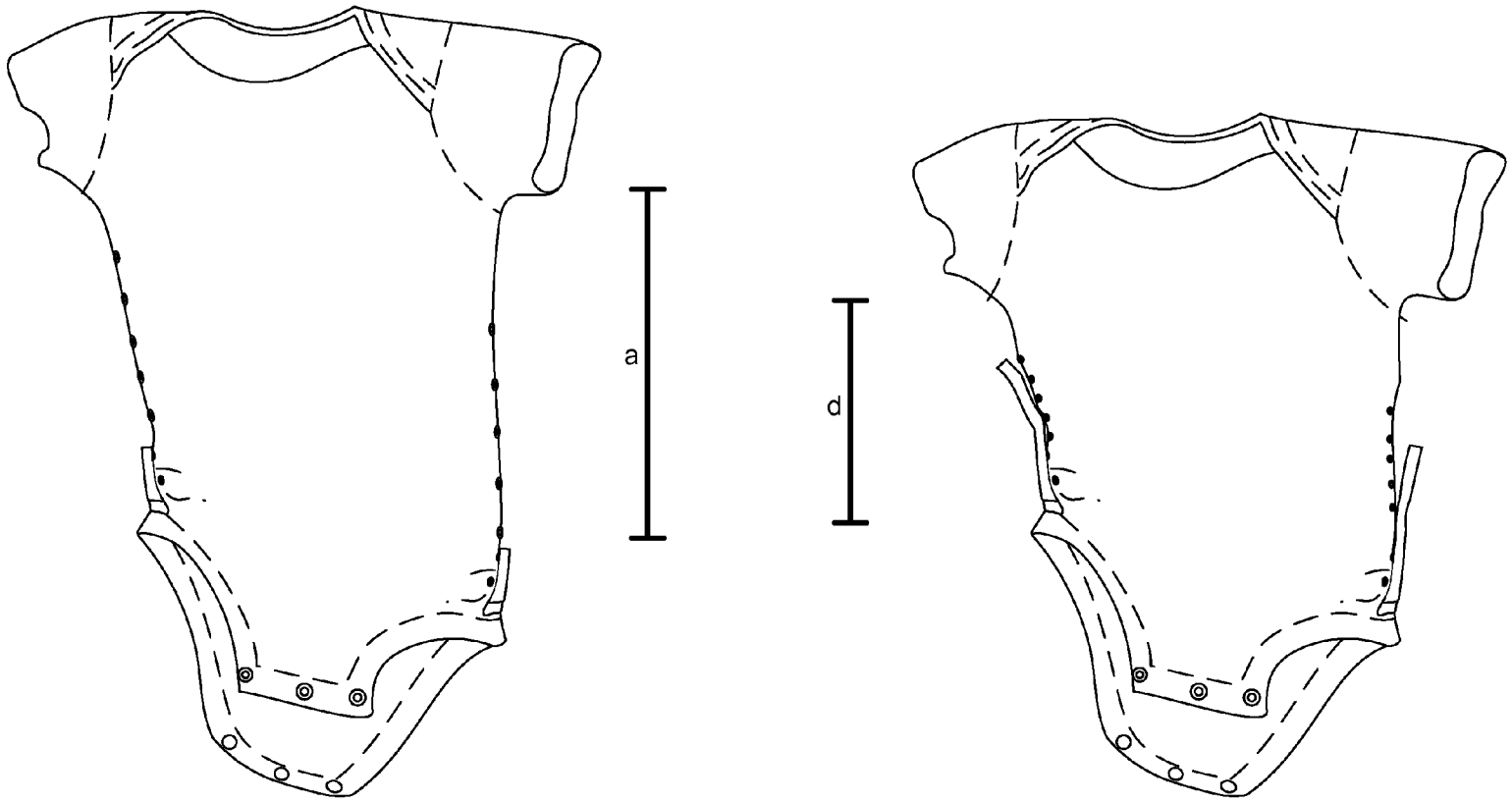

In a preferred methodology of use, a length of the garment 10 can be adjusted by pulling the straps 28 further through the respective strap channels such that a larger extent of each of the straps 28 is threaded through an opening of the strap channel and located exterior to the strap channel. FIGS. 3-5 illustrate an exemplary such methodology where a user pulls upwardly and outwardly on the straps 28 to increase the extent of the straps 28 disposed exterior to the strap channels and thereby decreases the length of the garment 10. In particular, a length of a portion of the garment 10 defined generally between armholes of the garment 10 and legholes of the garment 10 decreases from a first length a to ever-decreasing lengths b,c,d as a larger extent of the straps 28 is pulled outside of the strap channels and disposed exterior to the strap channels, as illustrated in FIGS. 3-5. The overall result is that the length decreases from the initial length a to the much shorter length d, as illustrated in FIG. 6.

Preferably, the garment 10 is configured for securement of the straps 28 with various length extents of the straps 28 disposed exterior to the strap channels such that the garment 10 can be secured in a plurality of different configurations of various lengths. Such securement is preferably accomplished via use of one or more fastening members, such as snaps, buttons, or hook and loop fastening members.

Figure 7:
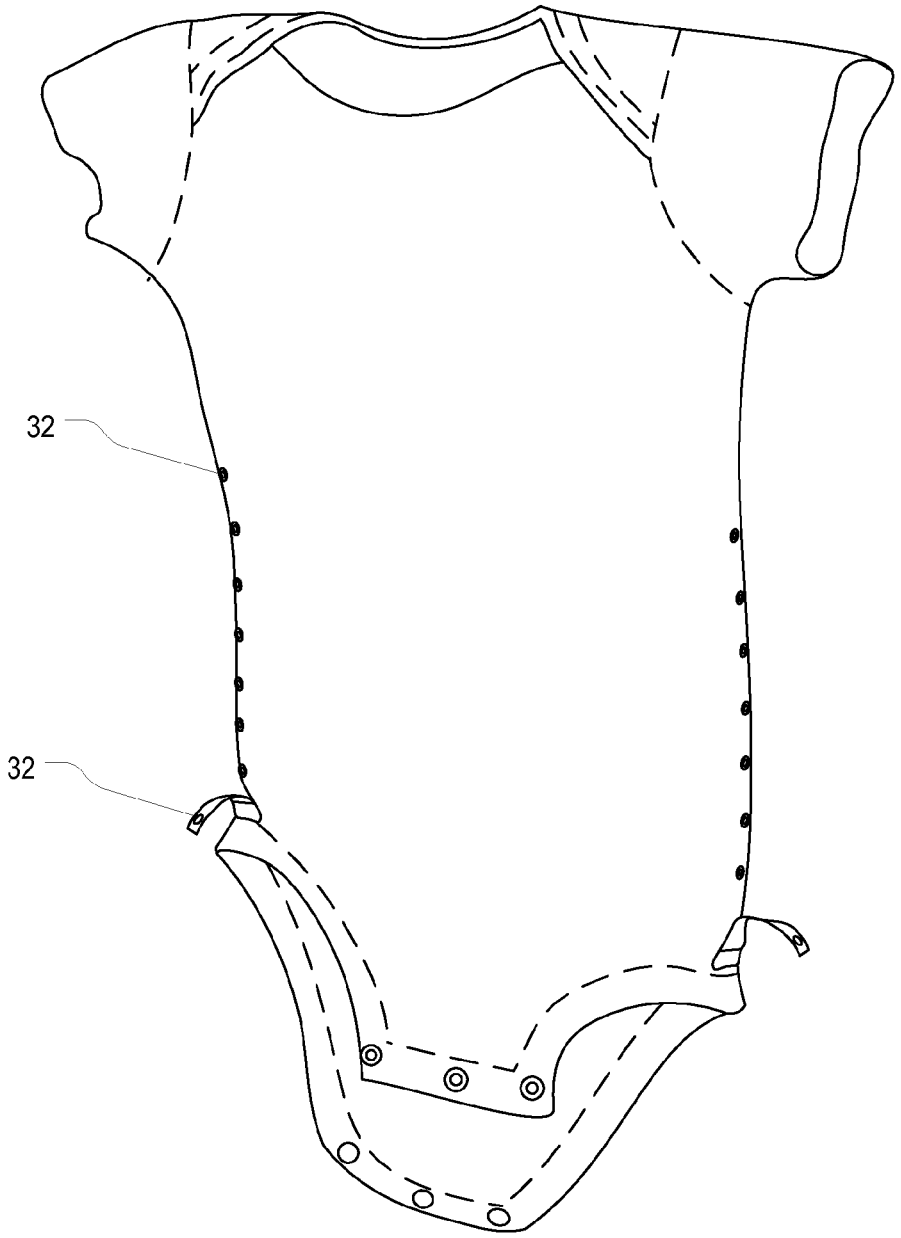
FIG. 7 illustrates an exemplary implementation of a garment in which snaps are utilized.
Figure 8:
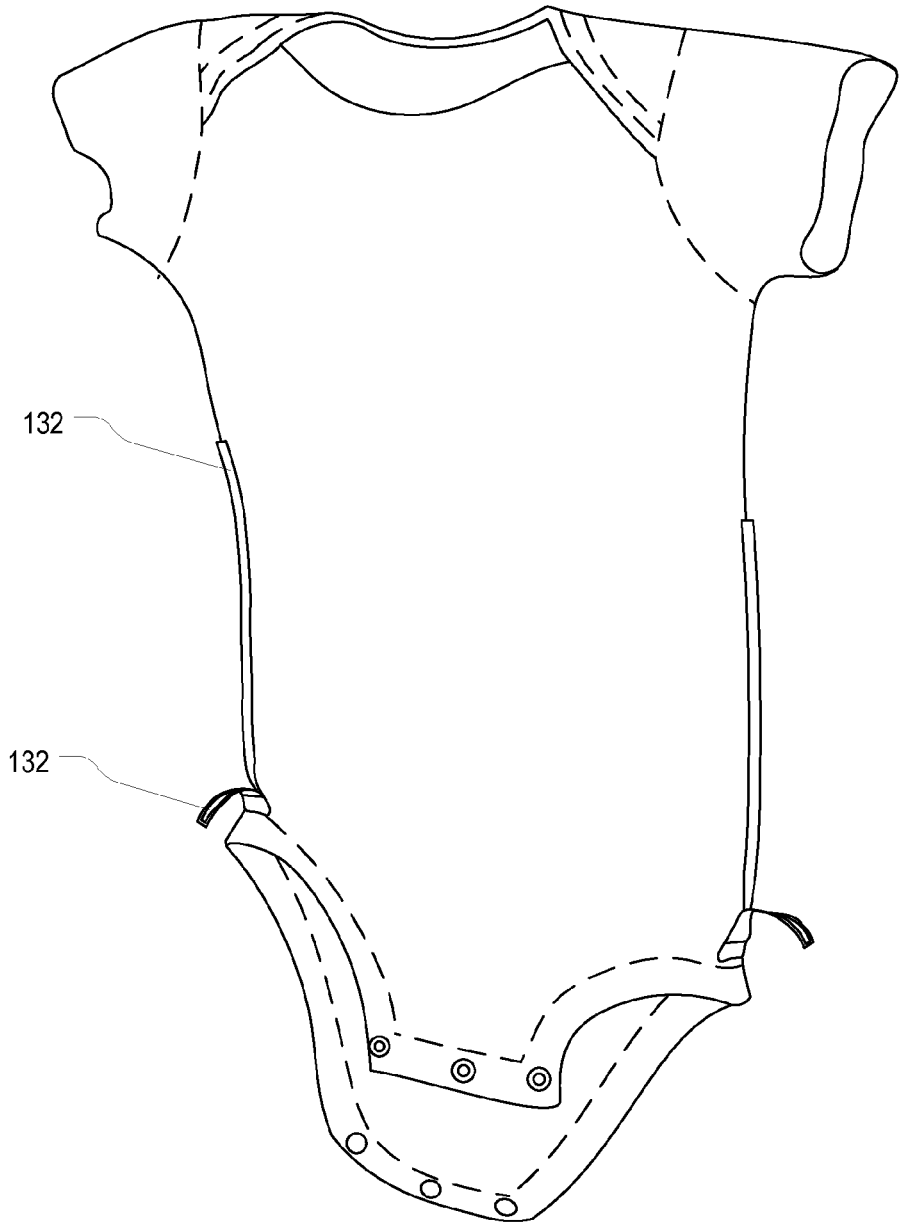
FIG. 8 illustrates an exemplary implementation of a garment in which hook and loop fasteners are utilized.

FIG. 7 illustrates an exemplary implementation of a garment 10 in which snaps 32 are utilized, while FIG. 8 illustrates an exemplary implementation of a garment 110 in which hook and loop fasteners 132 are utilized.

Although the garments 10,110 illustrated herein do not include sleeves or leggings, in one or more preferred implementations a garment including sleeves or leggings similarly comprises one or more adjustable fit mechanisms.

Further, although the illustrations and description herein has primarily focused on garments 10,110 for an infant or small child, in one or more preferred implementations adjustable fit mechanisms are utilized for other types of garments, such as, for example, one-piece adult loungewear, uniforms, or jumpsuits.

Based on the foregoing description, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention. Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements, the present invention being limited only by the claims appended hereto and the equivalents thereof

What is claimed is:

1. An adjustable garment for a child comprising:

(a) a body portion configured to generally fit about a body of a child, (b) a first adjustable fit mechanism disposed at a first side of the body portion, the first adjustable fit mechanism comprising (i) a first strap channel defined through the body portion at the first side, (ii) a first set of one or more fastening members affixed to an interior of the body portion, the first set of one or more fastening members being disposed externally to, but in overlapping disposition with, the first strap channel, and (iii) an elastic first strap at least partially received within the first strap channel, wherein (A) a first end of the first strap is secured to an interior of the body portion at a first attachment point within the first strap channel at the first side of the body portion proximate a chest portion of the body portion, (B) the first strap includes a second set of one or more fastening members affixed to the first strap proximate a second end of the first strap, (C) the first strap is threaded through the first strap channel such that a first extent of the first strap is disposed within the first strap channel and a second extent of the first strap is disposed exterior to the first strap channel, and (D) wherein the second extent is bent back such that it overlaps a portion of the first extent, and a secured portion of the first strap that is disposed exterior to the first strap channel is removably secured to the body portion via coupling of one or more fastening members of the second set of one or more fastening members with one or more fastening members of the first set of one or more fastening members;

(b) a second adjustable fit mechanism disposed at a second side of the body portion, the second adjustable fit mechanism comprising (i) a second strap channel defined through the body portion at the second side, (ii) a third set of one or more fastening members affixed to an interior of the body portion, the third set of one or more fastening members being disposed externally to, but in overlapping disposition with, the second strap channel, and (iii) an elastic second strap at least partially received within the second strap channel, wherein (A) a first end of the second strap is secured to an interior of the body portion at a second attachment point within the second strap channel at the second side of the body portion proximate a chest portion of the body portion, (B) the second strap includes a fourth set of one or more fastening members affixed to the second strap proximate a second end of the second strap, (C) the second strap is threaded through the second strap channel such that a first extent of the second strap is disposed within the second strap channel and a second extent of the second strap is disposed exterior to the second strap channel, and (D) wherein the second extent is bent back such that it overlaps a portion of the first extent, and a secured portion of the second strap that is disposed exterior to the second strap channel is removably secured to the body portion via coupling of one or more fastening members of the fourth set of one or more fastening members with one or more fastening members of the third set of one or more fastening members;

(d) wherein the adjustable garment is configured such that a length of the adjustable garment can be increased by (i) unsecuring the secured portion of the first strap from the body portion by decoupling the one or more fastening members of the second set of one or more fastening members from the one or more fastening members of the first set of one or more fastening members, (ii) decreasing the second extent of the first strap disposed exterior to the first strap channel, (iii) re-securing the first strap to the body portion at the first side by coupling one or more fastening members of the second set of one or more fastening members to one or more fastening members of the first set of one or more fastening members, (iv) unsecuring the secured portion of the second strap from the body portion by decoupling the one or more fastening members of the fourth set of one or more fastening members from the one or more fastening members of the third set of one or more fastening members, (v) decreasing the second extent of the second strap disposed exterior to the second strap channel, and (vi) re-securing the second strap to the body portion at the second side by coupling one or more fastening members of the fourth set of one or more fastening members to one or more fastening members of the third set of one or more fastening members;

(e) wherein the adjustable garment is configured such that a length of the adjustable garment can be decreased by (i) unsecuring the secured portion of the first strap from the body portion by decoupling the one or more fastening members of the second set of one or more fastening members from the one or more fastening members of the first set of one or more fastening members, (ii) pulling a loose end of the first strap towards the first attachment point within the first strap channel thereby increasing the second extent of the first strap disposed exterior to the first strap channel, (iii) re-securing the first strap to the body portion at the first side by coupling one or more fastening members of the second set of one or more fastening members to one or more fastening members of the first set of one or more fastening members, (iv) unsecuring the secured portion of the second strap from the body portion by decoupling the one or more fastening members of the fourth set of one or more fastening members from the one or more fastening members of the third set of one or more fastening members, (v) pulling a loose end of the second strap towards the second attachment point within the second strap channel thereby increasing the second extent of the second strap disposed exterior to the second strap channel, and (vi) re-securing the second strap to the body portion at the second side by coupling one or more fastening members of the fourth set of one or more fastening members to one or more fastening members of the third set of one or more fastening members.

2. The adjustable garment of claim 1, wherein fastening members of the first and third sets of one or more fastening members comprise male fastening members, and fastening members of the second and fourth sets of one or more fastening members comprise female fastening members.

3. The adjustable garment of claim 1, wherein fastening members of the first and third sets of one or more fastening members comprise female fastening members, and fastening members of the second and fourth sets of one or more fastening members comprise male fastening members.

4. The adjustable garment of claim 1, wherein one or more fastening members of the first and third sets of one or more fastening members comprise one or more hook fastening members, and one or more fastening members of the second and fourth sets of one or more fastening members comprise one or more loop fastening members.

5. The adjustable garment of claim 1, wherein one or more fastening members of the first and third sets of one or more fastening members comprise one or more loop fastening members, and one or more fastening members of the second and fourth sets of one or more fastening members comprise one or more hook fastening members.

6. The adjustable garment of claim 1, wherein one or more fastening members of one of the first, second, third, and fourth sets of one or more fastening members comprises a button fastening member.

7. The adjustable garment of claim 1, wherein one or more fastening members of one of the first, second, third, and fourth sets of one or more fastening members comprises a snap fastening member.

8. The adjustable garment of claim 1, wherein one or more fastening members of one of the first, second, third, and fourth sets of one or more fastening members comprises a hook and loop fastening member.

9. The adjustable garment of claim 1, wherein the second and fourth sets of one or more fastening members each includes only a single fastening member.

10. The adjustable garment of claim 1, wherein the first and third sets of one or more fastening members each includes only a single fastening member.

11. The adjustable garment of claim 1, wherein the first, second, third, and fourth sets of one or more fastening members each includes only a single fastening member.

12. The adjustable garment of claim 1, wherein the adjustable garment comprises sleeves.

13. The adjustable garment of claim 1, wherein the adjustable garment is sleeveless.

14. The adjustable garment of claim 1, wherein the adjustable garment does not include leggings.

15. A method comprising:

(a) decreasing a length of an adjustable garment, the adjustable garment comprising (i) a body portion configured to generally fit about a body of a child, (ii) a first adjustable fit mechanism disposed at a first side of the body portion, the first adjustable fit mechanism comprising (A) a first strap channel defined through the body portion at the first side, (B) a first set of one or more fastening members affixed to an interior of the body portion, the first set of one or more fastening members being disposed externally to, but in overlapping disposition with, the first strap channel, and (C) an elastic first strap at least partially received within the first strap channel, wherein (I) a first end of the first strap is secured to an interior of the body portion at a first attachment point within the first strap channel at the first side of the body portion proximate a chest portion of the body portion, (II) the first strap includes a second set of one or more fastening members affixed to the first strap proximate a second end of the first strap, (III) the first strap is threaded through the first strap channel such that a first extent of the first strap is disposed within the first strap channel and a second extent of the first strap is disposed exterior to the first strap channel, and (IV) wherein the second extent is bent back such that it overlaps a portion of the first extent, and a secured portion of the first strap that is disposed exterior to the first strap channel is removably secured to the body portion via coupling of one or more fastening members of the second set of one or more fastening members with one or more fastening members of the first set of one or more fastening members, (ii) a second adjustable fit mechanism disposed at a second side of the body portion, the second adjustable fit mechanism comprising (A) a second strap channel defined through the body portion at the second side, (B) a third set of one or more fastening members affixed to an interior of the body portion, the third set of one or more fastening members being disposed externally to, but in overlapping disposition with, the second strap channel, and (C) an elastic second strap at least partially received within the second strap channel, wherein (I) a first end of the second strap is secured to an interior of the body portion at a second attachment point within the second strap channel at the second side of the body portion proximate a chest portion of the body portion, (II) the second strap includes a fourth set of one or more fastening members affixed to the second strap proximate a second end of the second strap, (III) the second strap is threaded through the second strap channel such that a first extent of the second strap is disposed within the second strap channel and a second extent of the second strap is disposed exterior to the second strap channel, and (IV) wherein the second extent is bent back such that it overlaps a portion of the first extent, and a secured portion of the second strap that is disposed exterior to the second strap channel is removably secured to the body portion via coupling of one or more fastening members of the fourth set of one or more fastening members with one or more fastening members of the third set of one or more fastening members;

(b) wherein decreasing a length of the adjustable garment comprises decreasing a length of the adjustable garment by (i) unsecuring a secured portion of the first strap from the body portion by decoupling the one or more fastening members of the second set of one or more fastening members from the one or more fastening members of the first set of one or more fastening members, (ii) pulling a loose end of the first strap towards the first attachment point within the first strap channel thereby increasing the second extent of the first strap disposed exterior to the first strap channel, (iii) re-securing the first strap to the body portion at the first side by coupling one or more fastening members of the second set of one or more fastening members to one or more fastening members of the first set of one or more fastening members, (iv) unsecuring the secured portion of the second strap from the body portion by decoupling the one or more fastening members of the fourth set of one or more fastening members from the one or more fastening members of the third set of one or more fastening members, (v) pulling a loose end of the second strap towards the second attachment point within the second strap channel thereby increasing the second extent of the second strap disposed exterior to the second strap channel, and (vi) re-securing the second strap to the body portion at the second side by coupling one or more fastening members of the fourth set of one or more fastening members to one or more fastening members of the third set of one or more fastening members.

16. The method of claim 15, wherein one or more fastening members of one of the first, second, third, and fourth sets of one or more fastening members comprises a snap fastening member.

17. The method of claim 15, wherein one or more fastening members of one of the first, second, third, and fourth sets of one or more fastening members comprises a hook and loop fastening member.

* * * * *